United States Patent [19]

Stringer

[11] Patent Number: 4,712,597

[45] Date of Patent: Dec. 15, 1987

[54] KNIFE HOLDER FOR WOOD CHIPPERS

[76] Inventor: George E. Stringer, Box 450, Tylertown, Miss. 39667

[21] Appl. No.: 844,697

[22] Filed: Mar. 27, 1986

[51] Int. Cl.[4] ..... B27C 1/14

[52] U.S. Cl. ..... 144/176; 144/162 R

[58] Field of Search ..... 144/162 R, 176

[56] References Cited

U.S. PATENT DOCUMENTS 2,337,407 12/1943 Ottersland ..... 144/176

2,388,799 11/1945 Payzer et al. ..... 144/176

4,187,891 2/1980 Weill ..... 144/176

*Primary Examiner*—W. D. Bray

*Attorney, Agent, or Firm*—Alexander H. Plache

[57] ABSTRACT

In a preferred embodiment, an improved knife holder for use in wood chippers of the type having a series of substantially radially positioned knives mounted on a rapidly rotatable disc which eliminates the use of a separate counter knife by combining the knife holder and counter knife presently used into one unit the wear area of which is hard-surfaced for longevity.

4 Claims, 4 Drawing Figures

KNIFE HOLDER FOR WOOD CHIPPERS

BACKGROUND, OBJECTS & SUMMARY OF THE INVENTION

This invention relates to an improved knife-holder for wood chippers of the type having a series of substantially radially positioned knives mounted on a rapidly rotatable disc. The improved knife-holder completely eliminates the recessed and tapped holes used for attaching a counter knife to the holder and, additionally, completely eliminates the counter-knife itself, thereby creating a much-improved holding power in the knife-holder assembly. The instant invention effectively combines the counter-knife and knife holder currently used into one solid unit.

Conventional wood chippers for reducing slabs, logs or even entire trees to wood chips generally employ a rotatably mounted cutting disc. The cutting disc is usually formed from a mild steel and may be approximately five inches thick. A plurality of cutting blades or knives are mounted adjacent apertures on the cutting discs to be rotated therewith. The rotating disc is mounted on a base structure and typically includes a wear plate mounted to the face of the disc. The cutting knives which may be from twelve to thirty-six inches in length are secured to the aperture sides of the disc by a knife holder, counter knife and knife clamp, all of which are bolted directly or indirectly to the rotating disc. A housing surrounds the disc and includes an opening through which the wood to be chipped may be passed. The opening is covered by a spout which terminates in a feed plate adjacent an anvil. During rotation of the disc, the cutting knives are passed adjacent the face of the anvil and at such an angle so as to draw in the raw material to produce wood chips which are expelled through an exhaust chute usually at the periphery of the housing. The wood chips are generally employed in the paper mill industry.

The anvil, the feed plate, the wear plate mounted on the rotating disc, the knife clamp, the counter knife, and the knife holder are all subjected to wear due to the extreme frictional and impact forces incurred during operation. Since close tolerances are involved with respect to the clearance between the stationary and the rotating parts and due to the relatively high rpm at which the massive steel disc rotates, these wear parts must be replaced quite frequently to maintain efficient operation of the chipper.

Due to the relatively high cost of each of these individual wear parts, attempts have been made to repair the worn parts for reuse. All of these prior attempts to repair or resurface the wear parts have been to varying extents unsuccessful for various reasons. Moreover, the current design of wood chippers employing a knife holder and counter knife allows small wood chips, splinters and wood dust to become lodged or packed between the counter knife and knife holder and inside the head of the Allen screws which typically hold the counter knife to the knife holder and around the screws themselves. This not only makes it difficult to change the counter knife but also adversely effects the alignment of the cutting tool.

Another problem with the current design is that sufficient strength to properly position the cutting knife is difficult to achieve through the use of a counter knife in the knife holder assembly. This exacerbates the problem of dust and chip particles packing between the holder and counter knife and between the counter knife and chipper knife. When this occurs, a safety hazard results. Continued use of the machine can irreparably damage the counter knife, chipper knife and knife holder. Moreover, damage to other parts of the machine can occur.

It is therefore an object of the present invention to provide an improved knife holder assembly which is simple and durable in construction and highly efficient in use, and which solves the problems caused by the use of the conventional knife holder which incorporates a counter knife in its design.

The instant invention substantially reduces the cost of the knife holder assembly. The invention eliminates the necessity to mill out a recess for the counter knife and the drilling and tapping of holes to affix the counter knife to the knife holder. Also, the invention eliminates the bolts holding the counter knife to the knife holder and the counter knife itself. Because all of the foregoing parts have to be machined for close tolerances to insure proper clearances between such parts and other moving parts of the machine and between such parts themselves, the elimination of the counter knife eliminates the necessity of insuring that these tolerances are met with respect to an additional wear part. The present invention not only helps eliminate these costs but also eliminates the necessity of replacing the knife holder itself as often as is done so now. Furthermore, because the instant invention incorporates the practice of hard surfacing the wear surface of the knife holder, the new assembly will last many times longer than that presently used. Currently, the counter knife and the knife holder itself wear considerably during operation.

The present invention will eliminate all of the foregoing problems because it is manufactured without the counter knife, thereby eliminating the need for a machined slot and clamping screws to secure the counter knife. This allows for a more durable, more secure, safer and less expensive knife holder assembly. When the instant knife holder does need replacement, the replacement thereof is much easier and can be performed more quickly than replacing the currently available knife holder assembly which includes a counter knife.

PRIOR ART

A patentability search conducted in this matter has revealed the following patents, none of which need to be distinguished from the subject matter of the instant invention:

| | |
|---|---|
| 2,337,407 | Ottersland |
| 2,388,799 | Payzer, et al |
| 2,570,845 | Ottersland |
| 2,712,904 | Durkee |
| 3,384,311 | Eklund, et al |
| 3,542,302 | Salzmann, Jr. |
| 3,415,297 | Yock |
| 3,976,271 | Larsson, et al |
| 4,047,670 | Svensson |
| 4,059,884 | Weill |
| 4,155,384 | Svensson |
| 4,187,891 | Weill |
| 4,298,044 | Hansel, et al |
| 4,317,544 | Lapointe |
| 4,423,758 | Haller, et al |
| 4,503,893 | Demopoulos |
| 4,545,413 | Sundberg, et al |

DETAILED DESCRIPTION OF THE PREFERRED EMBODIMENT

Figure 1:
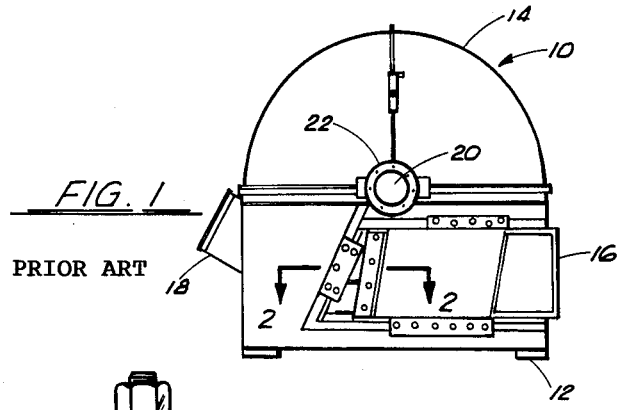
FIG. 1 PRIOR ART
FIG. 1 illustrates a typical wood chipper of the type having a series of substantially radially positioned knives mounted on a rapidly rotatable disc. This is a side view with the axis of rotation of the disc in the center of the figure.
Figure 2:
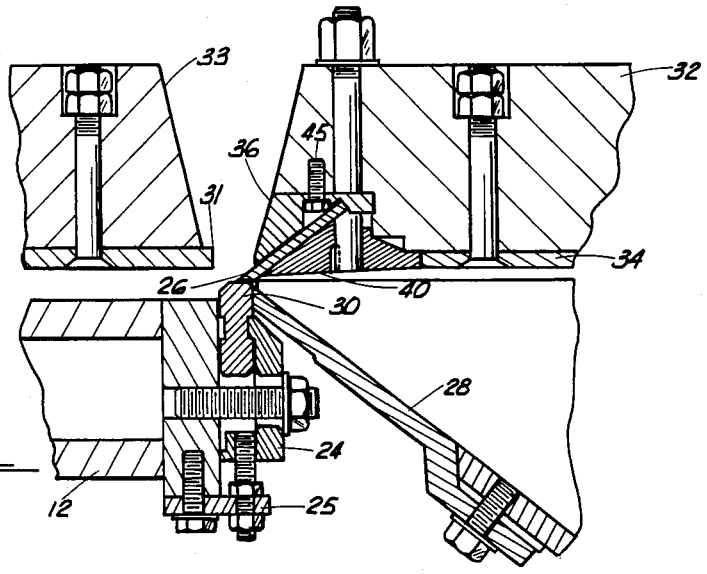
FIG. 2 PRIOR ART
FIG. 2 shows a cutaway of the disc with the knife holder mounted thereto. The view shows how the wood chipper appears from above and includes the method of attaching the knife holder assembly to the disc. The disc is on the top portion of the drawing and the attachment bolts are shown protruding through the cutaway of the disc.

A typical wood chipper of the type having a series of substantially radially positioned knives mounted on a rapidly rotatable disc and employing the improved knife holder which is the subject invention is shown in FIG. 1 and generally designated 10. As shown, the wood chipper 10 includes a base 12, a protective housing 14 including an inlet shute 16 and an exhaust chute 18. A steel chipper is disc 32 (FIG. 2) is secured to a shaft 20. The shaft 20 is rotatably supported within a pair of spaced journal bearings 22. The wood to be chipped enters the machine through the inlet 16, and as best seen in FIG. 2, abuts a vertical anvil 30 supported by an anvil clamp 24 and keeper plate 25. A feed plate 28 extends from the inlet 16 and abuts the vertical anvil 30. The rotating steel disc 32 has a disc-shaped wear plate 34 bolted to one face thereof. Disc 32 and plate 34 each include apertures 31 and 33, respectively, having configurated edge surfaces and tapered outwardly from the front to the back of the chipper to permit wood chips to pass through the chipper disc and plate.

An arrangement including a knife holder 36, and a knife clamp 40 is secured by suitable bolts to the disc 32 adjacent apertures 31 and 33 and serves to retain the knife 26 in position.

In operation, the disc 32 of the wood chipper illustrated in FIGS. 1 and 2 is rotated at approximately 850 revolutions per minute by a suitable engine (not shown) coupled to drive shaft 22 to which disc 32 is secured. As the wood is fed into chute 16 and abuts anvil 30, the knives slice chips from the end of the wood which are expelled through apertures 31 and 33 and finally from the chipper through chute 18 for collection.

Figure 3:
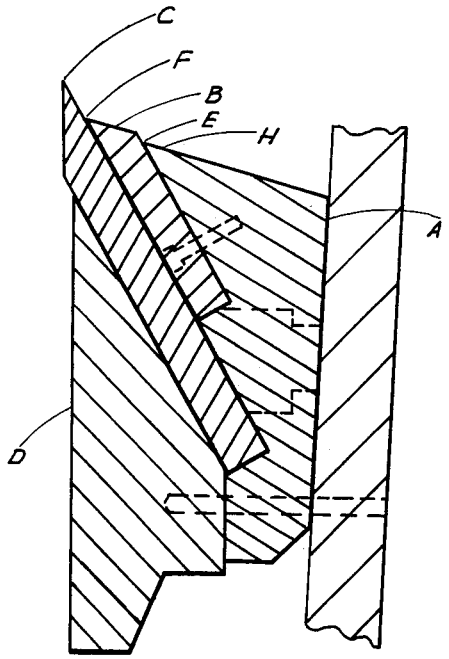
FIG. 3 PRIOR ART
FIG. 3 illustrates the knife holder assembly including the counter knife which is presently employed in wood chippers of this type and upon which the improved knife holder is based.

FIG. 3 depicts the chipper knife holder assembly which is presently employed in conventional chippers. The assembly consists of a knife holder, counter knife, chipper knife, and a knife clamp. The knife holder (A) is mounted to the steel chipper disc, which rotates in a circular motion. The knife holder is attached to the disc with bolts to secure it in place or by other appropriate means. The counter knife (B) is mounted and secured to the knife holder (A) with small set screws or by other appropriate means. The chipper knife (C) is placed between the counter knife (B) and the knife clamp (D). The knife clamp (D) employs studs which protrude through the chipper disc and which can be tightened, thereby causing a vice-type action to secure the chipper knife (C), the counter knife (B), and knife holder (A).

The counter knife (B) is used in this method so it can be replaced when it becomes worn. The counter knife is located in an area of extreme wear. Accordingly, use of a counter knife in conventional wood chippers reduces somewhat the necessity of replacing the entire knife holder as the counter knife wears. However, the knife holder itself is nonetheless subjected to extreme wear in conventional wood chippers. In most cases the holder is made of a mild steel and has no preventative against severe wear. The counter knife (B) will on an average last for a period of thirty (30) to ninety (90) days, depending on the amount of material put through the machine. When a counter knife wears to the point that it needs replacement, the counter knife is discarded and a new one installed. The cost of a replacement counter knife ranges from $30 to $100, depending on machine size.

During use, a gap (E) between the counter knife (B) and the knife holder (A), and a gap (F) between the counter knife (B) and the chipper knife (C) eventually forms and widens through vibration of the assembly. This causes an opening to occur at point (E) and point (F), leaving room for fine chips, sawdust and other debris to accumulate between these two points. This accumulation is commonly known as "packing" Once this starts occurring, debris will accumulate with increasing rapidity, eventually producing enough stress in this area to break the screws holding the counter knife (B) to the knife holder (A). Moreover, this accumulation causes the knife holder at point (H) to bend back away from the counter knife to a greater extent. As the packing gets worse, the danger increases for the possibility of the counter knife (B) and the chipper knife (C) loosening up and coming ut of the machine while it is running. This represents a severe hazard to anyone standing near the machine while it is cutting chips.

The chipper knife (C) is a knife blade that actually cuts the wastewood into chips. The knife blade when dull can be resharpened and put back into the machine to run again. This process is repeated until the knife is too small.

Figure 4:
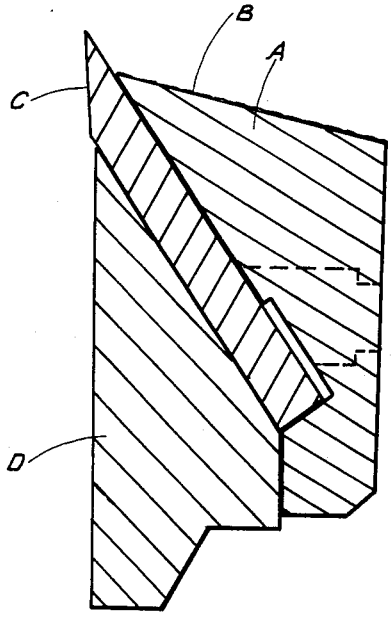
FIG. 4 illustrates the improved knife holder which is the subject of the instant invention and which eliminates the counter knife.

FIG. 4 depicts the improved knife holder which is the subject of the instant invention. The new knife holder (A) eliminates the problems illustrated in FIG. 3 by eliminating the counter knife altogether and improving the strength of the knife holder thereby giving the chipper knife a more firm, stable, and solid clamping principle. Making the knife holder thicker will give more strength to the base metal and will give the chipper knife a solid base from each side in the clamping mechanism. This will stabilize the assembly in a more solid way. By using this method, the hazards which result from the accumulation of debris or packing between the gaps that inevitably form between the various parts of knife holder assemblies presently used employing a counter knife are eliminated.

The wear area of the improved knife holder depicted in FIG. 4 is also hard-surfaced by fusing a powdered material into the base metal or by some other method. The use of a hard surfaced material in the portion of the knife holder which is subjected to wear during normal operations (B) results in a much stronger, material for these wear parts. In fact, a rockwell hardness of up to 65 or 75 R.C. can be achieved through hard surfacing by fusing a powdered material into the base metal or by some other method. Our experience indicates that this procedure gives the new knife holder a much longer life than the previous assembly employing a counter knife.

I claim:

1. Am improved knife holder for wood chippers of the type having a series of substantially radially positioned knives mounted on a rapidly rotatable disc wherein the improvement comprises combining the knife holder and counter knife presently used into one unit, said knife holder comprising one solid piece of steel with a flat surface secured to the base of the chipper disc by one or more bolts mounted within a recess in the flat surface of the chipper disc and having an adjacent surface which extends outward from the chipper disc at an angle of between 90 degrees and 150 degrees from the flat surface which abuts the chipper disc, which surface is the wear surface of the holder in that chips are impelled against this surface during the operation of the chipper, causing the surface to wear, to a desired distance from the chipper disc at which point another flat surface extends at a desired angle of between 30 degrees and 90 degrees therefrom, which surface includes a shallow recess located at one end of the length of the surface, to a point where it meets another surface which extends at an angle of 90 degrees therefrom to a point which is immediately adjacent to a knife clamp utilized to clamp the knife in position between the knife holder and clamp, said surfaces forming a recess into which the chipper knife is mounted and secured through clamping action between the knife clamp and knife holder.

2. The improved knife holder of claim one wherein the wear surface of the holder is comprised of a hard-surfaced material and thereby strengthened.

3. The improved knife holder of claim 2, wherein the wear surface of the holder is hard-surfaced with a powdered material which is fused into the base metal.

4. The improved knife holder of claim 3, wherein the wear surface of the holder is hard-surfaced with a powdered material which is fused into the base metal through the use of acetylene and oxygen.

* * * * *